United States Patent [19]

Stein, Sr.

[11] Patent Number: 4,992,063

[45] Date of Patent: Feb. 12, 1991

[54] ELECTRICAL CONNECTOR

[75] Inventor: William L. Stein, Sr., Warren, Ohio

[73] Assignee: General Motors Corporation, Detroit, Mich.

[21] Appl. No.: 546,994

[22] Filed: Jul. 2, 1990

[51] Int. Cl.[5] ..... H01R 13/436

[52] U.S. Cl. ..... 439/752

[58] Field of Search ..... 439/752, 595, 733

[56] References Cited

U.S. PATENT DOCUMENTS

| | | | |
|---|---|---|---|
| 4,066,325 | 1/1978 | Pearce, Jr. et al. | 339/176 |
| 4,352,535 | 10/1982 | McNamee, Sr. et al. | 339/75 |
| 4,583,805 | 4/1986 | Mantlik | 339/61 R |
| 4,602,839 | 7/1986 | Winger | 339/91 |
| 4,714,437 | 12/1987 | Dyki | 439/595 |
| 4,749,372 | 6/1988 | Betsui | 439/595 |
| 4,826,452 | 5/1989 | Sian et al. | 439/595 |
| 4,891,021 | 1/1990 | Hayes et al. | 439/752 |

*Primary Examiner*—Gary F. Paumen

*Attorney, Agent, or Firm*—Francis J. Fodale

[57] ABSTRACT

An electrical connector comprises a connector body having two rows of terminal cavities that are on opposite sides of a divider wall that terminates in a tapered projection that extends part way into a common lateral slot at the cable end of the connector body. A bifurcated lock member is attached to the connector body to prevent withdrawal of the electrical terminals disposed in the terminal cavities. The bifurcated lock member has two plates that are spread apart by the tapered projection so that substantially the ends of the plates are solidly behind short stop tabs of the electric terminals in the respective rows.

5 Claims, 1 Drawing Sheet

ELECTRICAL CONNECTOR

BACKGROUND OF THE INVENTION

This invention relates generally to electrical connectors and more specifically to electrical connectors that have a separate lock piece that is attached to a connector body to prevent withdrawal of terminals disposed in terminal cavities in the connector body.

U.S. Pat. No. 4,066,325 granted to Warren Pearce, Jr. and Andrew Russo, Jr. Jan. 3, 1978 discloses an electrical connector for a printed circuit board that has two rows of terminals disposed in a connector body. A separate lock plate is slid into a lateral slot associated with each row of terminals to prevent withdrawal of all terminals in the associated row.

U.S. Pat. No. 4,352,535 granted to James W. McNamee, Sr. and Daniel N. Kosareo Oct. 5, 1982 also discloses an electrical connector having two rows of terminals disposed in a connector body and a separate lock bar associated with each row of terminals to prevent withdrawal of the terminals.

U.S. Pat. No. 4,602,839 granted to James L. Winger July 29, 1986 is another example of an electrical connector having two rows of terminals disposed in a connector body and a separate lock piece associated with each row of terminals to prevent terminal withdrawal.

SUMMARY OF THE INVENTION

The object of this invention is to provide an electrical connector having two rows of terminals and a single lock member that prevents withdrawal of all the terminals in both rows of terminals when the lock member is attached to the connector body of the electrical connector.

A feature of the invention is that the single lock member is positioned between the two rows of terminals when it is attached to prevent withdrawal of all the terminals.

Another feature of the invention is that the single lock member acts as an insulator which completes the electrical isolation of the terminals from each other.

Another feature of the invention is that the single lock member is bifurcated so that the connector body positions the lock member solidly behind both rows of terminals.

Yet another feature of the invention is that the single lock member and connector body are configured to accommodate terminals with relatively large cable attachment portions.

Still yet another feature of the invention is that the single lock member is bifurcated and spread apart by the connector body to position the lock member solidly behind depending stop tabs of the terminals that are relatively short.

Among the advantages of the invention are that it has fewer parts and a lower profile in comparison to prior art connectors that require separate lock members for each row of terminals.

Other objects and features of the invention will become apparent to those skilled in the art as disclosure is made in the following detailed description of a preferred embodiment of the invention which sets forth the best mode of the invention contemplated by the inventors and which is illustrated in the accompanying sheet(s) of drawing.

DETAILED DESCRIPTION OF THE PREFERRED EMBODIMENT

Figure 1:
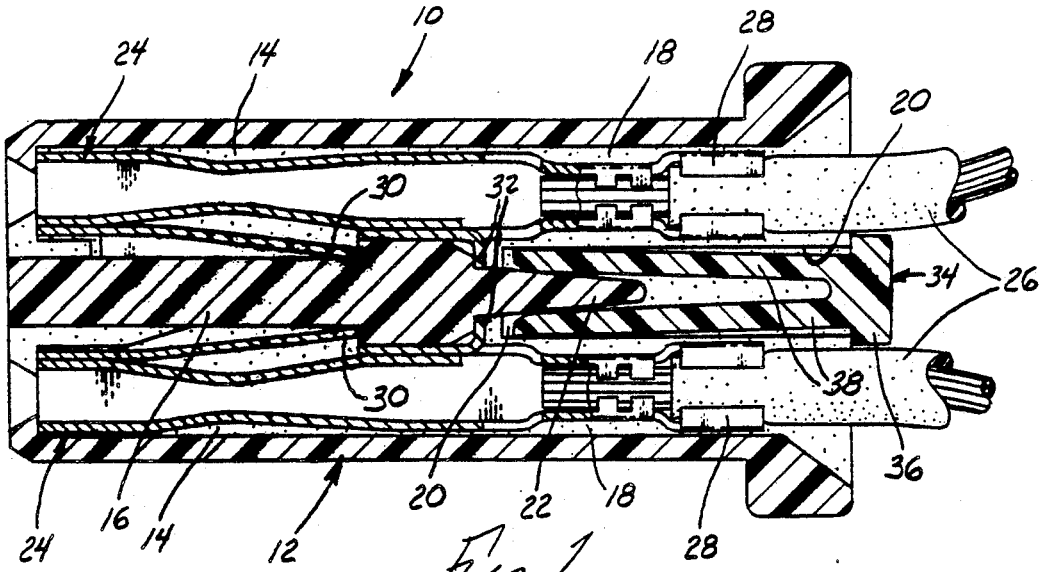
FIG. 1 is a longitudinal section of an electrical connector having a lock member in accordance with the invention.
Figure 2:
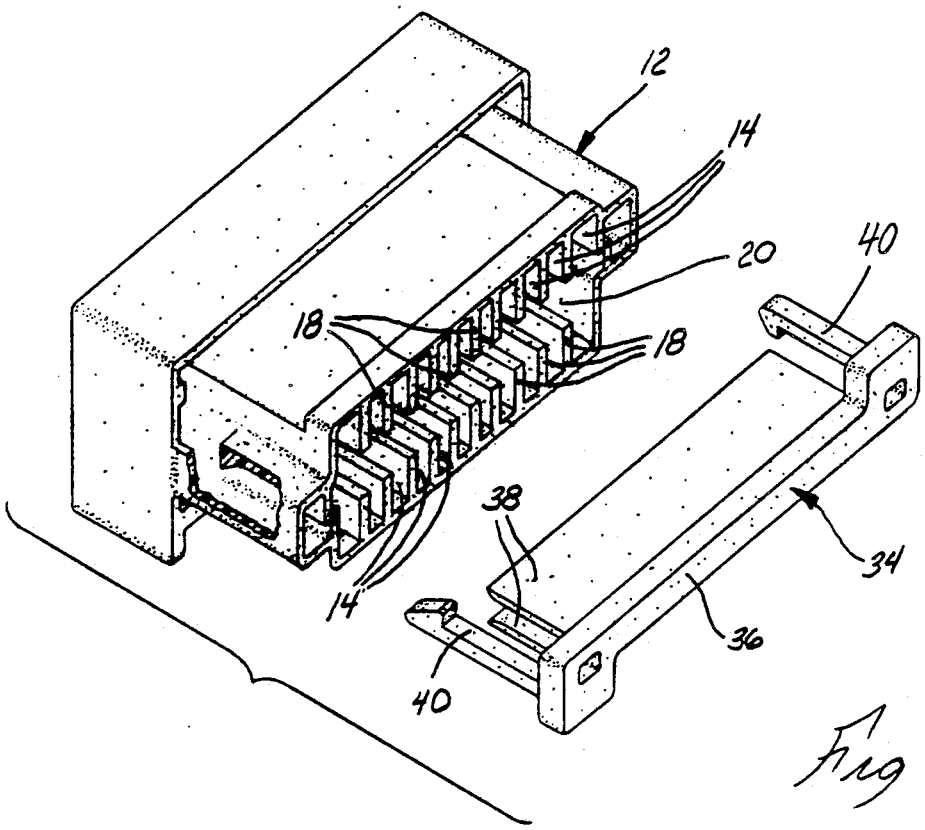
FIG. 2 is an exploded perspective view of the connector body and lock member shown in FIG. 1.

Referring now to the drawing, the electrical connector 10 comprises a connector body 12 having two rows of terminal cavities 14 on opposite sides of a divider wall 16. The terminal cavities 14 are separated from each other by vertical partitions 18 that extend the length of connector body 12. The vertical partitions 18 have medial cutouts aligned with the divider wall 16 that form a common lateral slot 20 at the cable end of the connector body 12. The divider wall 16 ends short of the cable end of the connector body 12 and terminates in a tapered projection 22 that extends part way into the common lateral slot 20.

The electrical connector 10 further comprises electric terminals 24 that are attached to electric cables 26 by conventional cable attachment portions 28. The electric terminals 24 are inserted into the terminal cavities 14 via openings at the cable end of the connector body 12. The electric terminals 24 are preferably retained in the terminal cavities 14 by conventional latch tangs 30 engaging cooperating shoulders of the divider wall 16 as shown in FIG. 1. The electric terminals 24 also have depending stop tabs 32 that engage other cooperating shoulders of the divider wall 16 to limit terminal insertion as also shown in FIG. 1. These stop tabs 32 are relatively short to maintain a low profile for the electrical connector 10.

The electrical connector 10 also includes a lock member 34 that is attached to the connector body 12 to prevent withdrawal of the electrical terminals 24 when a strong pull out force is applied to the electric cables 26 regardless of whether or not latch tangs 30 are present or operative.

The lock member 34 is bifurcated to position the lock member 34 solidly behind the stop tabs 32 of both rows of electrical terminals 24. It comprises a support 36 having two, integrally attached, parallel plates 38 that extend from the support 36 in cantilever fashion. The lock member 34 has a lock arm 40 at each lateral end that is located outboard of the parallel plates 38 so as to maintain the minimal height of the lock member 34.

After the electric terminals 14 are inserted into the terminal cavities 14, the lock member 34 is inserted into the common lateral slot 20 so that the free ends of the plates 38 enter first. During insertion, the tapered projection 22 of the divider wall 16 enters the space between the plates 38 and spreads the ends of the plates 38 apart so that substantially the full heights of the plates 38 are behind the stop tabs 32 of the electric terminals 24 in the respective rows. This provides a strong lock while accommodating relatively large attachment portions 28 for the electric terminals 24. The lock member 34 is retained in the terminal lock position by the lock arms 40 engaging cooperating lock shoulders of the connector body 12. When the lock member 34 is retained in the terminal lock position, each plate 38 acts as an insulator which closes off the terminal cavities 14 in one row. Thus the lock member 34 also completes the electrical isolation of the terminals 24 from each other.

I wish it to be understood that I do not desire to be limited to the exact details of construction shown and described, for obvious modifications will occur to a person skilled in the art.

The embodiments of the invention in which an exclusive property or privilege is claimed are defined as follows:

1. An electrical connector comprising:

a connector body having two rows of terminal cavities that are on opposite sides of a divider wall and that are separated from each other by vertical partitions, the vertical partitions having cutouts that form a common lateral slot at a cable end of the connector body, the divider wall ending short of the cable end of the connector body and terminating in a projection that extends part way into the common lateral slot, electric terminals that are attached to electrical cables being disposed in the terminal cavities, and a one-piece bifurcated lock member that is attached to but separable from the connector body to prevent withdrawal of the electrical terminals from the terminal cavities, the bifurcated lock member having portions disposed on opposite sides of and adjacent the projection and located by the projection solidly behind portions of the electric terminals in the respective rows.

2. The electrical connector as defined in claim 1 wherein the projection of the divider wall is tapered and spreads the ends of the bifurcated lock member portions apart so that substantially the full heights of the bifurcated lock member portions are behind the portions of the electric terminals in the respective rows.

3. An electrical connector comprising:

a connector body having two rows of terminal cavities that are on opposite sides of a divider wall and that are separated from each other by vertical partitions, the vertical partitions extending the length of the connector body and having cutouts that form a common lateral slot at a cable end of the connector body, the divider wall ending short of the cable end of the connector body and terminating in a tapered projection that extends part way into the common lateral slot, electric terminals that are attached to electrical cables being disposed in the terminal cavities, and having depending stop tabs that are relatively short, and a one-piece lock member that is attached to but separable from the connector body to prevent withdrawal of the electrical terminals from the terminal cavities, the lock member comprising a support having two, integrally attached, parallel plates that extend from the support in cantilever fashion, the plates being disposed on opposite sides of the tapered projection and having ends that are spread apart by the tapered projection so that the ends of the plates are solidly behind the stop tabs of the electric terminals in the respective rows.

4. The electrical connector as defined in claim 3 wherein the electric terminals are attached to the electric cables by relatively large attachment portions and wherein the ends of the plates are spread apart forwardly of the relatively large attachment portions.

5. The electrical connector as defined in claim 3 wherein the plates close off the terminal cavities in the respective rows and complete electrical isolation of the electric terminals from each other.

* * * * *